US009224375B1

(12) United States Patent
Hilderman

(10) Patent No.: US 9,224,375 B1
(45) **Date of Patent: *Dec. 29, 2015**

(54) MUSICAL MODIFICATION EFFECTS

(71) Applicant: The TC Group A/S, Risskov (DK)

(72) Inventor: David Kenneth Hilderman, Victoria (CA)

(73) Assignee: The TC Group A/S, Risskov (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/849,503

(22) Filed: Sep. 9, 2015

Related U.S. Application Data

(63) Continuation of application No. 14/059,116, filed on Oct. 21, 2013, now Pat. No. 9,159,310.

(60) Provisional application No. 61/716,427, filed on Oct. 19, 2012.

(51) Int. Cl.

| | |
|---|---|
| ***G10H 1/00*** | (2006.01) |
| ***G10K 15/08*** | (2006.01) |
| ***G10L 21/007*** | (2013.01) |
| ***H04R 29/00*** | (2006.01) |

(52) U.S. Cl.
CPC ..... *G10H 1/0091* (2013.01); *G10H 1/00* (2013.01); *G10K 15/08* (2013.01); *G10L 21/007* (2013.01); *H04R 29/00* (2013.01)

(58) Field of Classification Search
USPC ..... 84/612, 636
IPC ..... G10H 1/00,1/0091
See application file for complete search history.

(56) References Cited

U.S. PATENT DOCUMENTS

| | | | | |
|---|---|---|---|---|
| 4,184,047 | A | | 1/1980 | Langford |
| 4,489,636 | A | | 12/1984 | Aoki et al. |
| 5,256,832 | A | | 10/1993 | Miyake |
| 5,301,259 | A | | 4/1994 | Gibson et al. |
| 5,410,098 | A | | 4/1995 | Ito |
| 5,469,508 | A | | 11/1995 | Vallier |
| 5,518,408 | A | | 5/1996 | Kawashima et al. |
| 5,621,182 | A | * | 4/1997 | Matsumoto ..... G10H 1/366 434/307 A |
| 5,641,928 | A | | 6/1997 | Tohgi et al. |
| 5,642,470 | A | * | 6/1997 | Yamamoto ..... G10L 13/033 704/258 |
| 5,703,311 | A | * | 12/1997 | Ohta ..... G10H 7/10 704/209 |
| 5,712,437 | A | | 1/1998 | Kageyama |
| 5,719,346 | A | | 2/1998 | Yoshida et al. |
| 5,736,663 | A | * | 4/1998 | Aoki ..... G10H 1/0025 84/609 |
| 5,747,715 | A | * | 5/1998 | Ohta ..... G10H 1/02 84/604 |
| 5,848,164 | A | | 12/1998 | Levine |
| 5,857,171 | A | | 1/1999 | Kageyama et al. |
| 5,895,449 | A | * | 4/1999 | Nakajima ..... G10H 7/002 704/258 |
| 5,902,951 | A | | 5/1999 | Kondo et al. |
| 5,939,654 | A | | 8/1999 | Anada |

(Continued)

OTHER PUBLICATIONS

"VoiceLive 2 User's Manual", Apr. 2009, Ver. 1.3, TC Helicon Vocal Technologies Ltd.

(Continued)

*Primary Examiner* — David Warren
(74) *Attorney, Agent, or Firm* — Kolisch Hartwell, P.C.

(57) ABSTRACT

Systems, including methods and apparatus, for applying audio effects to a non-ambient signal, based at least in part on information received in an ambient audio signal. Exemplary effects that can be applied using the present teachings include generation of harmony notes, pitch-correction of melody notes, and tempo-based effects that rely on beat detection.

20 Claims, 2 Drawing Sheets

(56) References Cited

U.S. PATENT DOCUMENTS

| | | | | |
|---|---|---|---|---|
| 5,966,687 | A | 10/1999 | Ojard | |
| 5,973,252 | A | 10/1999 | Hildebrand | |
| 6,177,625 | B1 | 1/2001 | Ito et al. | |
| 6,266,003 | B1 | 7/2001 | Hoek | |
| 6,307,140 | B1 | 10/2001 | Iwamoto | |
| 6,336,092 | B1 | 1/2002 | Gibson et al. | |
| 7,016,841 | B2 * | 3/2006 | Kenmochi | G10L 13/07 704/258 |
| 7,088,835 | B1 | 8/2006 | Norris et al. | |
| 7,183,479 | B2 | 2/2007 | Lu et al. | |
| 7,241,947 | B2 * | 7/2007 | Kobayashi | G10L 13/033 704/268 |
| 7,373,209 | B2 | 5/2008 | Tagawa et al. | |
| 7,582,824 | B2 | 9/2009 | Sumita | |
| 7,667,126 | B2 | 2/2010 | Shi | |
| 7,974,838 | B1 | 7/2011 | Lukin et al. | |
| 8,168,877 | B1 | 5/2012 | Rutledge et al. | |
| 8,170,870 | B2 | 5/2012 | Kemmochi et al. | |
| 9,123,315 | B1 * | 9/2015 | Bachand | G10G 1/04 |
| 9,159,310 | B2 * | 10/2015 | Hilderman | G10H 1/366 |
| 2003/0009344 | A1 * | 1/2003 | Kayama | G10L 13/06 704/500 |
| 2003/0066414 | A1 | 4/2003 | Jameson | |
| 2003/0221542 | A1 * | 12/2003 | Kenmochi | G10H 7/002 84/616 |
| 2004/0112203 | A1 | 6/2004 | Ueki et al. | |
| 2004/0186720 | A1 * | 9/2004 | Kemmochi | G10H 5/00 704/258 |
| 2004/0187673 | A1 | 9/2004 | Stevenson | |
| 2004/0221710 | A1 | 11/2004 | Kitayama | |
| 2004/0231499 | A1 * | 11/2004 | Kobayashi | G10H 5/005 84/645 |
| 2006/0185504 | A1 * | 8/2006 | Kobayashi | G10H 1/0066 84/645 |
| 2008/0255830 | A1 | 10/2008 | Rosec et al. | |
| 2008/0289481 | A1 * | 11/2008 | Vallancourt | G10H 1/0091 84/615 |
| 2009/0306987 | A1 * | 12/2009 | Nakano | G10H 1/366 704/260 |
| 2011/0144982 | A1 | 6/2011 | Salazar et al. | |
| 2011/0144983 | A1 | 6/2011 | Salazar et al. | |
| 2011/0247479 | A1 | 10/2011 | Helms et al. | |
| 2011/0251842 | A1 | 10/2011 | Cook et al. | |
| 2012/0089390 | A1 | 4/2012 | Yang et al. | |
| 2013/0151256 | A1 * | 6/2013 | Nakano | G10L 13/033 704/268 |
| 2014/0039883 | A1 | 2/2014 | Yang et al. | |
| 2014/0136207 | A1 * | 5/2014 | Kayama | G10L 13/08 704/258 |
| 2014/0140536 | A1 | 5/2014 | Serletic, II et al. | |
| 2014/0180683 | A1 | 6/2014 | Lupini et al. | |
| 2014/0189354 | A1 | 7/2014 | Zhou et al. | |
| 2014/0244262 | A1 * | 8/2014 | Hisaminato | G10H 1/14 704/258 |
| 2014/0251115 | A1 | 9/2014 | Yamauchi | |
| 2014/0260909 | A1 | 9/2014 | Matusiak | |
| 2014/0278433 | A1 * | 9/2014 | Iriyama | G10L 13/02 704/261 |
| 2015/0025892 | A1 * | 1/2015 | Lee | G10L 21/003 704/267 |
| 2015/0040743 | A1 * | 2/2015 | Tachibana | G10H 1/361 84/622 |

OTHER PUBLICATIONS

VoiceLive 2 Extreme, software version 1.5.01, Apr. 2009, (obtained Jul. 11, 2013 at www.tc-helicon.com/products/voicelive-2-extreme/), TC Helicon Vocal Technologies Ltd.

"VoiceTone T1 User's Manual", Oct. 2010, TC Helicon Vocal Technologies Ltd.

VoiceTone T1 Adaptive Tone & Dynamics, Oct. 2010, (obtained Jul. 11, 2013 at www.tc-helicon.com/products/voicetone-t1/), TC Helicon Vocal Technologies Ltd.

VoiceLive Play, Jan. 2012, (obtained Jul. 11, 2013 at www.tc-helicon.com/products/voicelive-play/), TC Helicon Vocal Technologies Ltd.

"VoiceLive Play User's Manual", Jan. 2012, Ver. 2.1, TC Helicon Vocal Technologies Ltd.

"VoiceTone Mic Mechanic User's Manual" May 2012, TC Helicon Vocal Technologies Ltd.

Mic Mechanic, May 2012, (obtained Jul. 11, 2013 at www.tc-helicon.com/products/mic-mechanic), TC Helicon Vocal Technologies Ltd.

Harmony Singer, Feb. 2013, (obtained Jul. 11, 2013 at www.tc-helicon.com/products/harmony-singer), TC Helicon Vocal Technologies Ltd.

"Harmony Singer User's Manual", Feb. 2013, TC Helicon Vocal Technologies Ltd.

"Nessie: Adaptive USB Microphone for Fearless Recording", Jun. 2013, TC Helicon Vocal Technologies Ltd.

Mar. 5, 2015, First Action Interview Pilot Program Pre-Interview Communication from the U.S. Patent and Trademark Office, in U.S. Appl. No. 14/059,116, which shares the same priority as this U.S. application.

Apr. 2, 2015, Office Action from the U.S. Patent and Trademark Office, in U.S. Appl. No. 14/467,560, which shares the same priority as this U.S. application.

Jun. 10, 2015, Notice of Allowance from the U.S. Patent and Trademark Office, in U.S. Appl. No. 14/059,116, which shares the same priority as this U.S. application.

* cited by examiner

MUSICAL MODIFICATION EFFECTS

CROSS-REFERENCE

This application is a continuation of U.S. patent application Ser. No. 14/059,116, filed Oct. 21, 2013, which claims priority to U.S. Provisional Patent Application Ser. No. 61/716,427, filed Oct. 19, 2012, each of which is incorporated herein by reference.

INTRODUCTION

Singers, and more generally musicians of all types, often wish to modify the natural sound of a voice and/or instrument, in order to create a different resulting sound. Many such musical modification effects are known, such as reverberation ("reverb"), delay, voice doubling, tone shifting, and harmony generation, among others.

As an example, harmony generation involves generating musically correct harmony notes to complement one or more notes produced by a singer and/or accompaniment instruments. Examples of harmony generation techniques are described, for example, in U.S. Pat. No. 7,667,126 to Shi and U.S. Pat. No. 8,168,877 to Rutledge et al., each of which are hereby incorporated by reference. The techniques disclosed in these references generally involve transmitting amplified musical signals, including both a melody signal and an accompaniment signal, to a signal processor through signal jacks, analyzing the signals to determine musically correct harmony notes, and then producing the harmony notes and combining them with the original musical signals. As described below, however, these techniques have some limitations.

More specifically, generating musical effects relies on the relevant signals being input into the effects processor, which has traditionally been done through the use of input jacks for each signal. However, in some cases one or more musicians may be playing "unplugged" or "unmiked," i.e., without an audio cable connected to their instrument or, in the case of a singer, without a dedicated microphone. Using existing effects processors, it is not possible to involve the sounds generated by such unplugged instruments or voices to generate a musical effect.

DETAILED DESCRIPTION

The present teachings focus on how ambient audio signals may be used to provide information for generating musical effects that may be applied to a non-ambient audio signal with an effects processor, substantially in real time.

In this disclosure, the term "ambient audio signal" means an audio signal that is captured by one or more microphones disposed away from the source of the signal. For example, an ambient audio signal might be generated by an "unplugged" instrument, i.e. an instrument that is not connected to an effects processor by an audio cable, or by a singer who is not "miked up," i.e., who is not singing directly into a microphone.

To capture ambient audio signals, microphones might be disposed in various fixed locations within a music studio or other environment, and configured to transmit audio signals they capture to an effects box, either wirelessly or through audio cables. Alternatively or in addition, one or more microphones might be integrated directly into an effects box and used to capture ambient audio signals.

On the other hand, the term "non-ambient audio signal" is used in the present disclosure to mean an audio signal that is captured at the source of the signal. Such a non-ambient signal might be generated, for example, by a "plugged in" instrument connected to the effects processor through an audio cable, or by a singer who is "miked up," i.e., who is singing directly into a microphone connected to the effects processor wirelessly or through an audio cable. In this disclosure, the term "audio cable" includes instrument cables that can transmit sound directly from a musical instrument, and microphone cables that can transmit sound directly from a microphone.

To reiterate, in some cases a singer might not use a dedicated microphone or be "miked up," i.e., the singer might wish to sing "unplugged." The resulting sound signal is specifically excluded from the definition of a non-ambient audio signal, even if it is ultimately captured by a microphone. In fact, for purposes of the present disclosure, an unplugged singer's voice should be considered an ambient audio signal that can be captured by a microphone remote from the singer.

In a common scenario, the non-ambient audio signal may contain a "miked up" singer's voice, and the ambient signal may include accompaniment notes played by an unplugged guitar, other unplugged stringed instruments, and/or percussion instruments. However, the present teachings are not limited to this scenario, but can be applied generally to any non-ambient and ambient audio signals.

Figure 1:
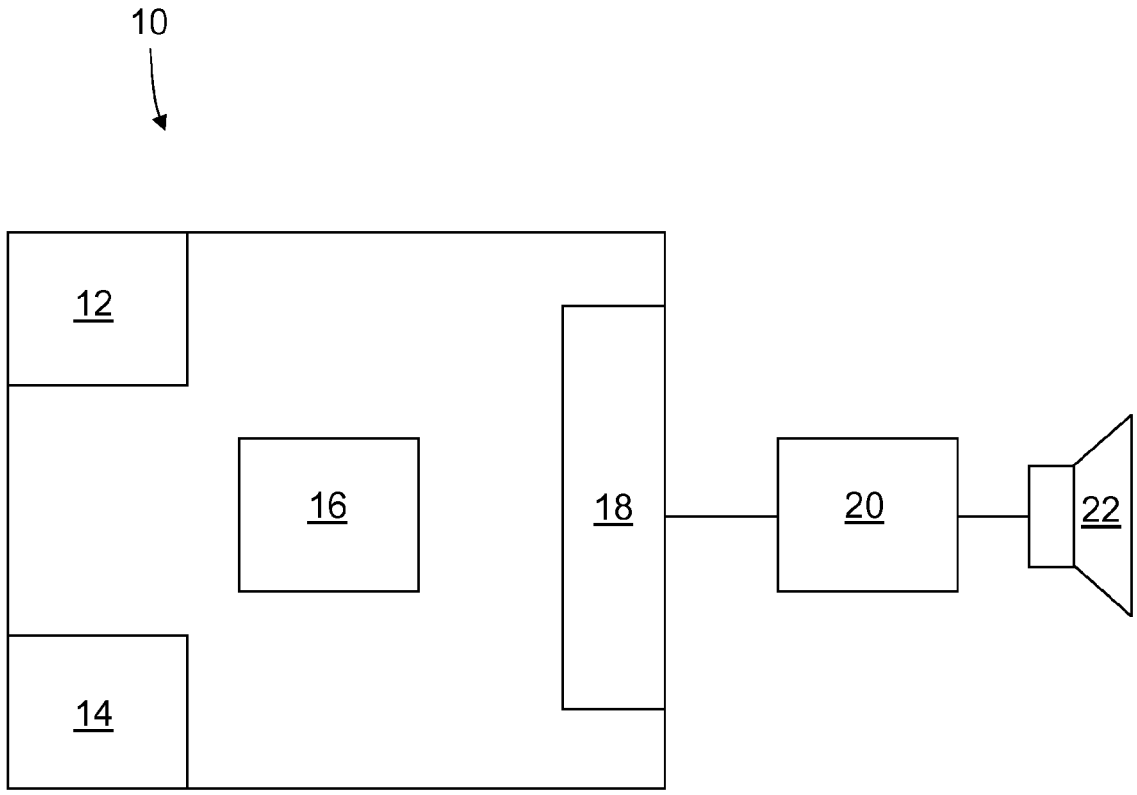
FIG. 1 is a block diagram schematically depicting an audio effect processing system, according to aspects of the present teachings.

FIG. 1 is a block diagram schematically depicting an audio effect processing system, generally indicated at 10, according to aspects of the present teachings. As described in detail below, system 10 may be used to generate a variety of desired audio or musical effects based on audio signals received by the system. System 10 typically takes the form of a portable rectangular box (i.e., an "effects box") having various inputs and outputs, although the exact form factor of system 10 can vary widely. Furthermore, as described below, in some cases system 10 may include one or more remotely disposed microphones for capturing ambient audio signals.

System 10 includes an input mechanism 12 configured to receive a non-ambient input audio signal, at least one microphone 14 configured to receive an ambient input audio signal, a digital signal processor 16 configured to apply an audio effect to the non-ambient audio signal based at least partially upon the ambient audio signal, and an output mechanism 18 configured to create an output audio signal incorporating the audio effect.

Input mechanism 12 may, for example, be an audio input jack configured to receive the non-ambient audio signal through an audio cable. For example, input mechanism 12 may be an input jack configured to receive a well-known XLR audio cable. Alternatively, input mechanism 12 may be a wireless receiver configured to receive a non-ambient audio signal that is transmitted wirelessly, such as by a wireless microphone disposed in close proximity to the source of the audio signal.

As described previously, when system 10 takes the form of a portable effects box, microphone 14 may in some cases be integrated directly into the box. In some cases, more than one microphone may be integrated into the effects box, for receiving ambient audio signals from different directions and/or within different frequency ranges. In other cases, microphone 14 and/or one or more additional microphones may be disposed remotely from the effects box and configured to transmit ambient audio signals to the box from different remote locations, either through audio cables or wirelessly, as is well known to sound engineers.

Digital signal processor 16 is configured to apply an audio effect to the non-ambient audio signal based at least partially upon the ambient audio signal, and to create an output audio signal incorporating the audio effect. For example, the non-ambient audio signal may include melody notes, such as notes sung by a singer, and the ambient audio signal may include accompaniment notes, such as notes or chords played by one or more accompaniment instruments. In this case, digital signal processor 16 may be configured to determine the melody notes received in the non-ambient audio signal and the musical chords represented by the accompaniment notes received in the ambient audio signal, and to determine one or more harmony notes which are musically complementary to, and/or consistent with, the melody notes received in the non-ambient audio signal and the accompaniment notes received in the ambient audio signal.

Processor 16 may be further configured to generate the determined harmony notes, or to cause their generation, and to produce or cause to be produced an output audio signal including at least the current melody note and the harmony note(s). More details of how harmony notes can be determined and generated based on received melody and accompaniment notes may be found, for example, in U.S. Pat. No. 7,667,126 to Shi and U.S. Pat. No. 8,168,877 to Rutledge et al., each of which has been incorporated into the present disclosure by reference. As indicated in those references, known techniques allow harmony notes to be determined substantially in real time with receiving melody notes in the non-ambient audio signal.

Alternatively or in addition, digital signal processor 16 may be configured to apply a tempo-based audio effect to the non-ambient audio signal, based on tempo information contained in the ambient audio signal. Examples of well known tempo-based effects include audio looping synchronization through audio time stretching, amplitude modulation, modulation of gender parameter of melody notes, modulation of gender parameter of harmony notes, stutter effect, modulation rate of delay based effects including flanging, chorus, detune, and modification of delay time in delay effects such as echo. Examples of the manner in which such effects may be applied to an audio signal can be found, for example, in U.S. Pat. Nos. 4,184,047, 5,469,508, 5,848,164, 6,266,003 and 7,088,835, each of which is hereby incorporated by reference into the present disclosure for all purposes.

In any case, in order to apply a tempo-based effect to the non-ambient audio signal, tempo information must first be extracted from the ambient audio signal. To accomplish this, digital signal processor 16 may be configured to determine tempo information from the ambient audio signal through beat detection, which generally involves detecting when local maxima in sound amplitude occur, along with determining the period between successive maxima. More details about known beat detection techniques can be found, for example, in *Tempo and beat analysis of acoustic musical signals*, Eric D. Scheirer, J. Acoust. Soc. Am. 103(1), January 1998; and in U.S. Pat. Nos. 5,256,832, 7,183,479, 7,373,209 and 7,582,824, each of which is hereby incorporated by reference into the present disclosure.

In another possible effect, digital signal processor 16 may be configured to determine a musical key of accompaniment notes received in the ambient audio signal, and to create modified, pitch-corrected melody notes by shifting melody notes received in the non-ambient audio signal into the musical key of the accompaniment notes. In this case, digital signal processor 16 may be configured to generate or cause to be generated an output audio signal including the pitch-corrected melody notes. In some cases, the output audio signal also may include the accompaniment notes. The general technique for analyzing the accompaniment notes to determine the musical key is discussed in U.S. Pat. No. 7,667,126 to Shi and U.S. Pat. No. 8,168,877 to Rutledge et al., each of which has been incorporated into the present disclosure by reference. Shifting the melody notes into the determined key typically involves a frequency change of each note, as is well understood among musicians and sound engineers. Pitch shifting of melody notes may be accomplished, for example, as described in U.S. Pat. No. 5,973,252 and/or U.S. Patent Application Publication No. 2008/0255830, each of which is hereby incorporated by reference for all purposes.

In yet another possible variation of the present teachings, system 10 may be configured to receive two separate non-ambient audio signals, the first for voice, the second for an instrument such as a guitar. For instance, system 10 may include two separate input mechanisms, or input mechanism 12 may be configured to receive two non-ambient signals. In this embodiment, the ambient audio input is used along with the second non-ambient audio signal to provide chord information for harmony and pitch correction processing on the first non-ambient signal input. The ambient audio input is used to provide tempo for modulation and delay effects on both the first and second non-ambient audio signals.

When two non-ambient audio signals are received, they may also be used for the purpose of providing the input audio for looping. Ambient audio produced by musicians performing along with this looped audio can then be used for beat detection. The beat detection is then used for audio time stretching of the looped audio to ensure tempo synchronization between the musicians producing the ambient audio and the looped audio. Synchronization by time stretching of the looped audio may be accomplished in real time, or the tempo of the ambient audio may be detected in real time and the position of the beat manually tapped into the effect processor through a footswitch or a button on the user interface. The synchronization of the looped audio is then applied only when the position of the beat is tapped. More details regarding known techniques for real time beat detection and time stretching may be found in U.S. Pat. Nos. 5,256,832, 6,266,003 and 7,373,209, each of which has been incorporated by reference into the present disclosure.

Output mechanism 18 will typically be an output jack integrated in the audio effects box of system 10 and configured to provide the output audio signal. For example, output mechanism 18 may be an output jack configured to receive a standard audio cable that can transmit the output audio signal, including any effects generated by digital signal processor 16, to an amplifier 20 and/or to a loudspeaker 22.

Figure 2:
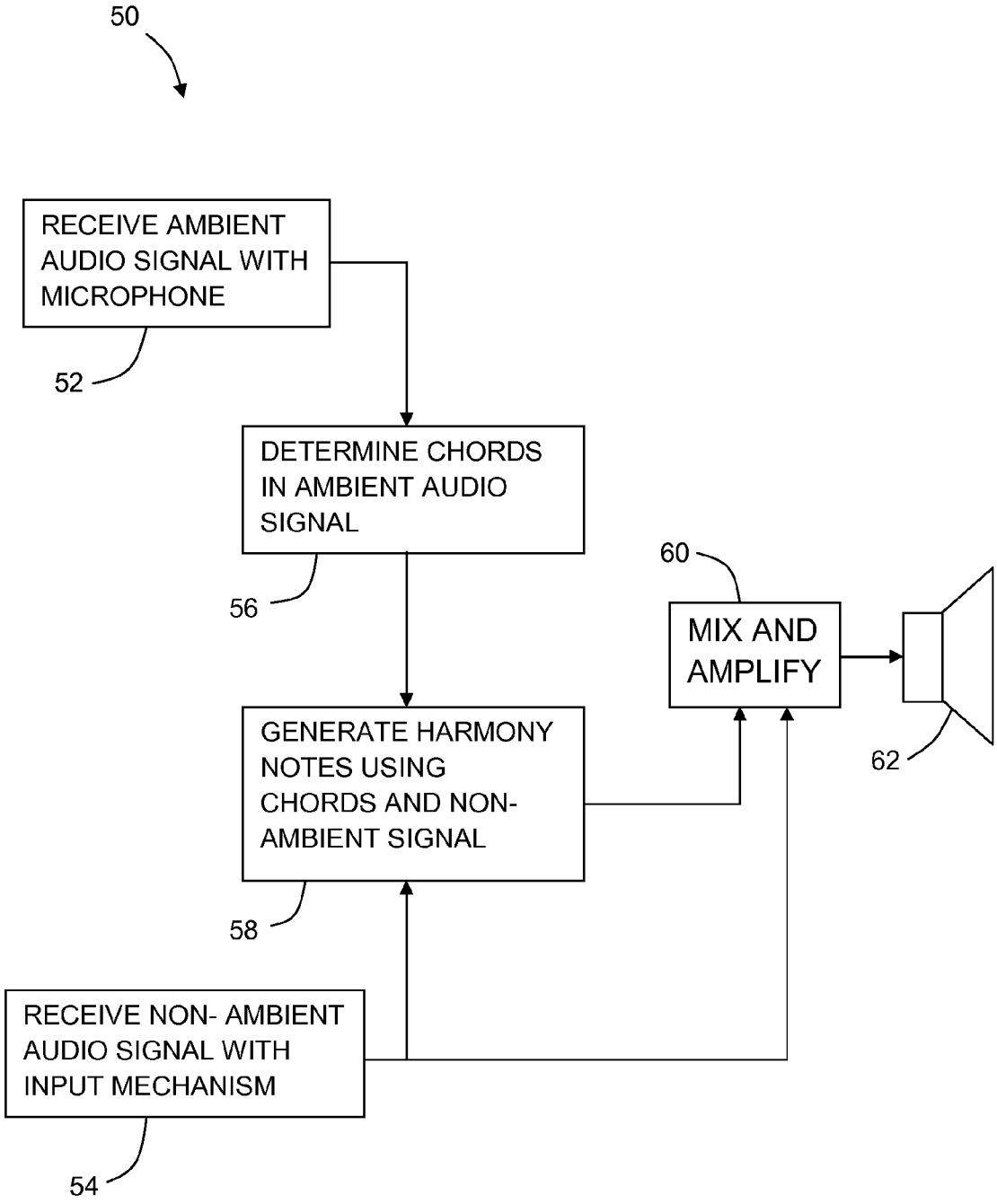
FIG. 2 is a flow diagram depicting a method of generating harmony notes, according to aspects of the present teachings.

FIG. 2 is a block diagram that exemplifies in more detail how the present teachings may accomplish harmony generation. More specifically, FIG. 2 depicts a method, generally indicated at 50, for generating musical harmony notes based on a non-ambient audio signal and an ambient audio signal. Method 50 includes receiving an ambient audio signal with at least one microphone configured to capture the ambient signal, as indicated at 52. Method 50 further includes receiving a non-ambient audio signal, including melody notes produced by a singer, with an input mechanism, as indicated at 54.

At 56, the ambient audio signal is processed by a digital signal processor to determine the musical chords contained in the signal. At 58, the chord information determined from the ambient audio signal and the melody notes received in the non-ambient signal are processed together to generate harmony notes that are musically consistent with both the melody and the chords. At 60, the harmony notes and the original melody notes are mixed and/or amplified by an audio mixer and amplifier, and at 62, the mixed signal is broadcast by a loudspeaker. More details about the chord detection and harmony generation steps may be found in U.S. Pat. No. 7,667,126 to Shi and U.S. Pat. No. 8,168,877 to Rutledge et al.

While certain particular audio effects have been described above, including harmony generation, tempo-based effects, and melody pitch-correction, the present teachings contemplate and can generally be applied to any audio or musical effects that involve audio signals from two separate sources, where one of the sources is ambient (i.e., "unplugged" or not "miked up") and the other is non-ambient (i.e., "plugged in" or "miked up").

What is claimed is:

1. A system for generating musical effects, comprising:

an input mechanism configured to receive a non-ambient input audio signal;

a microphone configured to receive an ambient input audio signal;

a digital signal processor configured to determine a tempo associated with the ambient input audio signal through beat detection, and to apply a tempo-based effect to at least one of the input audio signals based on the determined tempo, thereby creating a modified audio signal; and an output mechanism configured to provide an output audio signal including the modified audio signal.

2. The system of claim 1, wherein the tempo-based effect is applied to the non-ambient input audio signal.

3. The system of claim 2, wherein the non-ambient input audio signal includes melody notes produced by a singer's voice, and wherein the tempo-based effect is applied to the melody notes.

4. The system of claim 2, wherein the non-ambient audio signal is a pre-recorded track.

5. The system of claim 2, wherein the non-ambient audio signal is a pre-recorded loop.

6. The system of claim 5, wherein the tempo-based effect is audio looping synchronization through audio time stretching.

7. The system of claim 1, wherein the tempo-based effect is selected from the set consisting of amplitude modulation, modulation of gender parameter of melody notes, and modulation of gender parameter of harmony notes.

8. The system of claim 1, wherein the tempo-based effect is a stutter effect.

9. The system of claim 1, wherein the tempo-based effect is a modulation rate of delay based effect chosen from the group consisting of flanging, chorus, detune, and modification of delay time in an echo effect.

10. The system of claim 1, wherein the ambient audio signal includes notes played by a percussion instrument, and wherein the determined tempo is a tempo of the notes played by the percussion instrument.

11. The system of claim 1, wherein the ambient audio signal includes notes played by a stringed instrument, and wherein the determined tempo is a tempo of the notes played by the stringed instrument.

12. A system for generating musical harmony notes, comprising:

an input mechanism configured to receive a non-ambient audio signal;

a microphone configured to receive an ambient audio signal from a source disposed away from the microphone; and a digital signal processor configured to determine tempo information from the ambient audio signal by detecting local maxima in sound amplitude within the ambient audio signal along with a period between successive maxima, and further configured to apply a tempo-based effect to the non-ambient audio signal based on the determined tempo information, thereby generating a modified non-ambient audio signal.

13. The system of claim 12, further comprising an output mechanism configured to provide an output audio signal including the modified non-ambient audio signal.

14. The system of claim 13, wherein the input mechanism is an input jack configured to receive the non-ambient audio signal through an audio cable.

15. The system of claim 13, wherein the non-ambient audio signal includes at least one voice signal produced by a singer, and the ambient audio signal includes at least one instrumental signal produced by a stringed instrument.

16. The system of claim 15, wherein the stringed instrument is a guitar, and the output audio signal is produced substantially in real time with receiving the non-ambient audio signal.

17. The system of claim 12, wherein the ambient audio signal includes a first vocal signal generated by a first singer who is not singing directly into the microphone.

18. The system of claim 17, wherein the non-ambient audio signal includes a second vocal signal generated by a second singer.

19. A portable audio effects box, comprising:

an audio input jack configured to receive a non-ambient input audio signal through an audio cable;

at least one microphone integrated into the effects box and configured to receive an ambient input audio signal;

a digital signal process configured to extract tempo information from the ambient input audio signal and to apply a tempo-based effect to the non-ambient audio signal based on the tempo information, thereby generating a modified non-ambient audio signal; and an audio output jack configured to provide an output audio signal including the modified non-ambient audio signal.

20. The effects box of claim 19, further comprising at least one microphone disposed remotely from the effects box and configured to transmit ambient audio signals to the effects box from one or more remote locations.

* * * * *